US005594479A

United States Patent [19]

Inoue et al.

[11] Patent Number: 5,594,479

[45] Date of Patent: Jan. 14, 1997

[54] METHOD FOR MANUFACTURING INK JET RECORDING HEAD HAVING WATER-REPELLENT MATERIAL

[75] Inventors: Makoto Inoue, deceased, late of Kawasaki; by Tsuneo Inoue, heir, Yokosuka; Kazuaki Masuda, Kawasaki; Shigeo Toganoh, Tokyo; Manabu Sueoka, Kawasaki; Keiichi Murai, Kashiwa; Takashi Watanabe; Akira Goto, both of Yokohama; Motoaki Sato, Tokyo, all of Japan

[73] Assignee: Canon Kabushiki Kaisha, Tokyo, Japan

[21] Appl. No.: 151,778

[22] Filed: Nov. 15, 1993

Related U.S. Application Data

[63] Continuation of Ser. No. 733,155, Jul. 19, 1991, abandoned.

[30] Foreign Application Priority Data

| | | | |
|---|---|---|---|
| Jul. 21, 1990 | [JP] | Japan | 2-193686 |
| Mar. 8, 1991 | [JP] | Japan | 3-43658 |
| Mar. 8, 1991 | [JP] | Japan | 3-043671 |
| Mar. 8, 1991 | [JP] | Japan | 3-043672 |

[51] Int. Cl.[6] ..... B41N 2/16

[52] U.S. Cl. ..... 347/45; 347/47; 219/121.71

[58] Field of Search ..... 347/45, 47, 63, 347/65, 56; 219/121.7, 121.71

[56] References Cited

U.S. PATENT DOCUMENTS

| | | | |
|---|---|---|---|
| 3,418,302 | 12/1968 | Darby | 260/87.5 |
| 3,601,576 | 8/1971 | Schlafli | 219/121.71 |
| 3,978,030 | 8/1976 | Resnick | 526/247 |
| 4,279,500 | 7/1981 | Kondo et al. . | |
| 4,313,124 | 1/1982 | Hara . | |
| 4,345,262 | 8/1982 | Shirato et al. . | |
| 4,450,455 | 5/1984 | Sugitani | 347/47 |
| 4,459,600 | 7/1984 | Sato et al. . | |
| 4,463,359 | 7/1984 | Ayata et al. . | |
| 4,522,907 | 6/1985 | Mitsuhashi et al. . | |
| 4,558,333 | 12/1985 | Sugitani et al. . | |
| 4,723,129 | 2/1988 | Endo et al. | 347/56 |
| 4,740,796 | 4/1988 | Endo et al. . | |
| 4,829,319 | 5/1989 | Chan | 347/47 |
| 4,897,475 | 1/1990 | Schroepfer et al. | 540/83 |
| 5,017,946 | 5/1991 | Masuda et al. | 347/45 |
| 5,043,747 | 8/1991 | Ebisawa | 347/45 |
| 5,059,973 | 10/1991 | Watanabe | 347/56 |
| 5,126,768 | 6/1992 | Nozawa | 347/65 |
| 5,208,604 | 5/1993 | Watanabe | 347/47 |

FOREIGN PATENT DOCUMENTS

| | | | |
|---|---|---|---|
| 367541 | 9/1990 | European Pat. Off. | B41J 2/16 |
| 54-56847 | 5/1979 | Japan | B41M 5/26 |
| 56-89569 | 7/1981 | Japan | B41J 3/04 |
| 58-175666 | 10/1983 | Japan | B41J 3/04 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 132768 | 7/1985 | Japan | B41J 3/04 |

(List continued on next page.)

*Primary Examiner*—Joseph W. Hartary

*Attorney, Agent, or Firm*—Fitzpatrick, Cella, Harper & Scinto

[57] ABSTRACT

A method of manufacturing a recording head for use in an ink jet head involves providing a discharge port formation member having a surface in which orifices are to be formed, treating a discharge port face of the discharge port formation member with a water-repellent material, and forming orifices by applying radiation from a pulsed laser beam to the discharge port formation member which has been treated by the material having a water-repellent property, so that forming the orifices creates byproducts. The method also involves sticking at least once a tape having an adhesive layer against the discharge port face of the discharge port formation member against at least peripheral portions of the orifices having the byproducts created in the orifice forming step sticking thereto and deposited therein, and peeling the tape therefrom.

1 Claim, 11 Drawing Sheets

FOREIGN PATENT DOCUMENTS

| | | | |
|---|---|---|---|
| 178065 | 9/1985 | Japan | B41J 3/04 |
| 61-141565 | 6/1986 | Japan | B41J 3/04 |
| 61-291148 | 12/1986 | Japan | B41J 3/04 |
| 62-55154 | 3/1987 | Japan | B41J 3/04 |
| 64-122557 | 5/1988 | Japan | B41J 3/04 |
| 63-239063 | 10/1988 | Japan | B41J 3/04 |
| 63-238111 | 10/1988 | Japan | C08F 16/32 |
| 1131215 | 5/1989 | Japan | C08F 36/20 |
| 248953 | 2/1990 | Japan | B41J 2/045 |
| 2153744 | 6/1990 | Japan | B41J 2/045 |

ADVANCED CONTACT ANGLE ($\theta_A$)

RETRACTED CONTACT ANGLE ($\theta_{R1}$)

RETRACTED CONTACT ANGLE ($\theta_{R2}$)

METHOD FOR MANUFACTURING INK JET RECORDING HEAD HAVING WATER-REPELLENT MATERIAL

This application is a continuation of application Ser. No. 07/733,155 filed Jul. 19,1991, which is now abandoned.

BACKGROUND OF THE INVENTION

Field of the Invention and Related Art

The present invention relates to a manufacturing method for an ink jet recording head and the ink jet recording head treated with a water repellent in peripheral portions of discharge ports.

Among various recording methods currently known, the so-called ink jet recording method which allows the high speed recording is a quite effective recording method.

An ink jet recording head used in the ink jet recording method comprises a substrate on which energy generating elements having a heating resistor and a pair of electrodes electrically connected to the resistor are provided, and a grooved ceiling plate provided with grooves constituting liquid channels and discharge ports corresponding to energy generating elements, and a common liquid chamber for supplying the ink to the liquid channels by connection with the substrate. And the common liquid chamber has an ink supply port through which the ink is supplied.

In the recording head with such a constitution, physical properties (physical characteristics) on the surfaces of a plate member or the substrate and the ceiling plate constituting the discharge ports are significantly important in discharging the ink through the discharge ports stably at all times. That is, if liquid remaining may occur in a part of discharge port peripheries owing to the ink passing around or sticking to external surfaces (peripheries) of the discharge ports, there are some cases that the ink flying direction may be deviated from a normal predetermined direction, under the influence of remaining ink, when the ink is discharged from the discharge ports, and further, it is apprehended that its flying direction may be disordered for each discharge due to instability of liquid remaining state. Therefore, an excellent recording can not be obtained because the stable ink discharge state can not be maintained.

Also, if entire external surfaces around the discharge ports are covered with the ink film, the so-called splash phenomenon may arise, causing the scattering of discharged ink, so that the stable recording can not be performed. If ink remaining becomes large over the external surface of orifice or stagnant ink may fix, the recording head may result in inoperable state in which the ink can not be discharged.

This tendency may arise quite remarkably, when the high resolution recording is made with an increased nozzle density, or the driving is performed with a high frequency, i.e., when the high speed recording is tried, whereby a large problem may arise in improving the performance of the recording head.

In order to resolve the above problem that if ink liquid remaining occurs in peripheries of discharge ports, the stable discharge can not be performed, various proposals have been made heretofore in which a water-repellent layer 20 treated with the so-called water repellent is formed at least in peripheries of discharge ports, as disclosed for example in Japanese Laid-Open Patent Application No. 56-89569, Japanese Patent Publication No. 62-55154, Japanese Laid-Open Patent Application No.2-153744, and so on. As the water repellent useful in this water-repellent treatment, a variety of kinds such as silicone polymer or oligomer and fluorine polymer or oligomer can be cited.

By the way, the water-repellent layer 20 formed in the ink jet recording head must have an excellent water-repellent ability as well as a sufficient durability, for practical purposes.

Conventionally, in the ink jet recording method, a recovery operation of wiping a discharge port formation face with a cleaning blade is made to wipe away the ink adhering to the discharge port formation face further completely. Accordingly, the water-repellent layer is required to have an adhesiveness sufficient not to be peeled away or an abrasion resistance enough not to break the water-repellent layer even if rubbed out by the cleaning blade. If such a durability is insufficient, the water-repellent layer may be gradually peeled away or dropped off during the use of the head, even if the effect may be exhibited at the initial time of use, so that the stable ink discharge state can not be maintained.

In connection with the durability necessary for such ink jet recording head, there were some cases in which the water-repellent layer formed of a conventional water repellent might be not sufficient.

For example, specifically, when a water repellent which is relatively soft in hardness is used to make the adhesiveness with the discharge port formation face more excellent, the water repellent may be sometimes scratched off in a long-term use. In this case, such scratched water repellent will enter into discharge ports. In such a state, the meniscus position may be displaced, thereby causing a deviation of ink discharge direction, and yielding a deflection in the ink flying direction, so that the recording quality may be degraded. However, when the water-repellent layer is made of a water repellent having a high wiping durability and a very great hardness, there were some cases in which cracks or exfoliations might be caused by to the impact causes by the blade being brought into contact with the discharge port face.

Also, when a member surrounding the discharge ports is made of a plurality of different materials, it is requisite to form the water-repellent layer having a good adhesiveness with any of those materials, but no conventional water repellents meet that requirement sufficiently.

On the other hand, as previously described, in the ink jet head using the grooved ceiling plate in which the common liquid chamber, liquid channels, and a discharge port formation member are integrally formed, its grooved ceiling plate is made by molding, and thus is formed of one material. In this way, even though it is formed of one material, its material often must be selected from limited materials, owing to moldability or ink wetted property (wettability). Generally, a material such as polysulfone, polyether-sulfone-polyester or polyacetal is used, but such molding material may sometimes have insufficient adhesion with the water repellent, so that there was a problem that the water-repellent layer might be peeled away.

As one method in view of improving such an adhesiveness of the water repellent, a proposal has been made in which a predetermined pretreatment is applied for a water-repellent surface, for example.

For example, in Japanese Laid-Open Patent Application No. 61-141565, one method has been proposed in which ozonization is applied for the water-repellent surface, and then the water-repellent layer is provided. However, the connection between ozonized layer and water-repellent layer is not sufficient for the durability required for an ink jet recording head which performs the wiping with a cleaning blade.

Also, in Japanese Laid-Open Patent Application No. 61-291148, one method has been proposed in which a fluorine coating is made after treating the water-repellent surface by the use of a silane coupling agent. However, the durability against the wiping was insufficient because the silane coupling agent might not bond well strongly to the water-repellent surface. That is, a conventional pretreatment process could not cope with the improvement of water-repellent layer characteristics required for the ink jet recording head.

By the way, in the ink jet recording head which is made using the grooved ceiling plate in which a grooved substrate of common liquid chamber and liquid channels and a discharge port formation member are integrally formed, the present applicant has adopted a technology of forming discharge ports by using a laser beam.

That is, the machining of discharge ports with a pulsed laser beam is performed in such a way as to apply the laser beam from a back side of discharge port formation member (orifice plate) after treating the discharge port formation face with the water repellent. When the discharge ports are formed on the orifice plate using the pulsed laser beam, it has been found that there is a phenomenon that byproducts may be attached to the neighborhood of discharge ports during the laser beam machining, in examining a manufacturing method of the ink jet recording method.

When some byproducts with the laser beam machining are attached or deposited in the neighborhood of discharge ports, as above described, the condition of discharging the ink did not satisfy the required characteristics sufficiently. That is, if such byproducts are deposited on the water-repellent surface in the neighborhood of discharge ports, causing the deposited site to be in a state of hydrophilic property, such as phenomenon that the ink is attracted to its hydrophilic area can be seen in discharging the ink, so that the flying direction of liquid droplets are rendered unstable, thereby sometimes degrading the print quality.

SUMMARY OF THE INVENTION

Firstly, it is an object of the present invention to accomplish a strong bonded state of a water repellent with an orifice plate by adopting a pretreatment process before the water-repellent treatment thereon.

Also, secondly, it is an object of the present invention to maintain an excellent water-repellent state by finding a material having a very favorable water-repellent ability and a high durability as a water repellent applied to an orifice plate.

Further, thirdly, it is an object of the present invention to prevent bad effects with byproducts from the laser beam machining, after forming discharge ports on an orifice plate treated with a water repellent by a laser beam.

Further, fourthly, it is an object of the present invention to provide a manufacturing method of a recording head with which the water-repellent treatment for an orifice plate can most effectively work.

The present invention is to provide a manufacturing method of an ink jet head which can sustain a sufficient water-repellent property in a long term, as well as a superior wiping durability, and has a good print quality in the favorable ink discharge condition, and provide the ink jet head manufactured with such method.

It is an object of the present invention to provide a recording head and a manufacturing method therefor which can prevent the decrease of print quality by preventing the ink from sticking to the neighborhood of an orifice in such a way as to recover the water-repellent property in the neighborhood of the orifice by removing or treating in a predetermined process byproducts having a large hydrophilic property sticking to or deposited in the neighborhood of the orifice, after orifices are machined by radiating an orifice plate having a water-repellent layer on a discharge port face or made up of a water repellent by itself with a pulsed laser beam.

Also, an object of the present invention is to provide an ink jet recording head in which at least peripheral portions of discharge ports comprise a film which contain a polymer having a fluorine heterocyclic structure in the principal chain.

Further, an object of the present invention is to provide a manufacturing method of an ink jet head having discharge ports, ink channels communicating to said discharge ports, and energy generating elements for generating the energy used to discharge the ink which are provided in said ink channels, including,

- a process for adding the hydrophilic property on the side of a discharge port formation face in a workpiece for making the discharge ports,
- a process for providing an intermediate layer having a coupling agent containing Si on the face having the hydrophilic property added, and
- a process for providing a water-repellent layer adding the water-repellent property on an upper layer of the intermediate layer.

Further, an object of the present invention is to provide a manufacturing method of a recording head for use with an ink jet printer, including forming discharge ports by radiation with a pulsed laser beam after treating a surface of discharge port formation member on which the discharge ports are formed, with a material having the water-repellent property, and thereafter, making the heat treatment of byproducts resulted from the orifice machining sticking to or deposited in peripheries of discharge ports, or an orifice plate having byproducts sticking to peripheries of discharge ports.

Also, an object of the present invention is to provide a manufacturing method of a recording head having discharge ports, ink channels communicating with the discharge ports, and energy generating elements for generating the energy used to discharge the ink which are provided in the ink channels, including,

- a process for making the oxidation treatment of a surface on the discharge port formation face side in a workpiece for making the discharge ports,
- a process for providing an intermediate layer having a coupling agent containing Si on an oxidized face on the surface of the discharge port formation face side,
- a process for providing a film containing a polymer having a fluorine heterocyclic structure in the principal chain to add the water-repellent property to an upper layer of the intermediate layer,
- a process for forming discharge ports by radiating a member on which the discharge ports are formed, with a pulsed laser beam, and
- a process for making the heat treatment of a discharge port formation member as well as byproducts sticking to or deposited in peripheries of discharge ports.

Still another object of the present invention is to provide a method of manufacturing a recording head for use in an ink jet head by the steps of providing a discharge port formation member having a surface in which plural orifices are to be formed, treating a discharge port face of the discharge port formation member with a water-repellent material, forming plural orifices by applying radiation from a pulsed laser beam to the discharge port formation member which has been treated by the material having a water-repellent property, so that forming the orifices creates byproducts, and sticking at least once a tape having an adhesive layer against the discharge port face of the discharge port formation member against at least peripheral portions of the orifices having the byproducts created in the orifice forming step sticking thereto and deposited therein, and peeling the tape therefrom.

It should be noted that the present invention is concentrated on the neighborhood of discharge ports, for resolving the problems, and so thereafter, the invention will be described in detail in connection with only a part including discharge ports of a recording head, by extracting that part, but if meeting a main purpose of the present invention, any type of recording head is applicable to the present invention, as long as it discharges the ink through discharge ports.

Also, the present invention includes not only a recording head of the type in which a discharge port is formed at an end portion of liquid channel, but also a recording head of the type in which a discharge port is formed by adding an orifice plate provided with a bore of predetermined diameter at an end portion of liquid channel, apart from the liquid channel.

Here, in the present invention, a fluorine heterocyclic structure for use as a water repellent in an organic material of five to eight ring containing one or two hetero atoms in a chemical structural formula.

The hetero atom is an atom except for carbon (C), and more specifically, oxygen (O), nitrogen (N), sulfur (S) and phosphorus (P), among which oxygen (O) is appropriately used from the aspect of the chemical stability and safety.

In the present invention, a fluorine polymer having a hetero ring structure has a content ratio of fluorine of above 10 weight percent, more preferably above 25 weight percent, and most preferably above 50 weight percent, from the point of an ink repellent property (contact angle).

Also, the ratio of a ring structure in the principal chain is preferably above 10%, more preferably above 20%, and most preferably above 30%, from the point of the intended strength of film or the solubility into a solvent, or the adhesion with a substrate.

In the present invention, among fluorine polymers having a hetero ring structure, an amorphous polymer is preferably used. The amorphous polymer can exhibit the effects of the present invention more excellently, as it is superior in the strength of film, the adhesion with the substrate, and the evenness of film.

In the present invention, as the fluorine polymer having a hetero ring structure in the principal chain, polymers as described in U.S. Pat. No. 3,418,302, U.S. Pat. No. 3,978,030, Japanese Laid-Open Patent Application No. 63-238111, and Japanese Laid-Open Patent Application No. 1-131215 are preferably used.

Among them, polymers having the hetero ring structure as shown below are typical. However, the content of the present invention is not limited to such polymers.

①

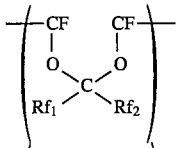

②

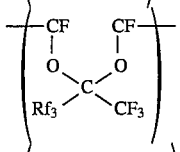

③

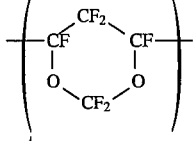

④

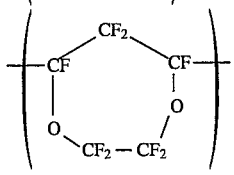

⑤

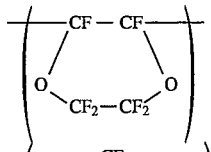

⑥

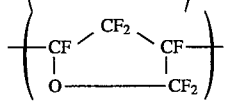

⑦

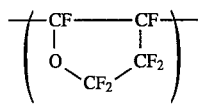

⑧

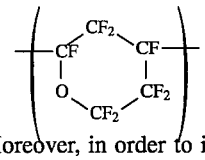

Moreover, in order to improve the adhesion with a substrate or control the solubility into Tg, a solvent, a structure such as

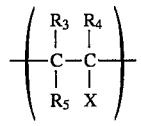

($R_3$, $R_4$, $R_5$ are H, F, Cl, Rf (fluorine containing alkyl), respectively. X is H, F, Cl, $Rf_3$, $Rf_4$. Where $Rf_3$ is a fluorine organic substitutional group having a functional group at the end, and $Rf_4$ is fluorine alkyl or fluorine ether.) can be introduced into the principal chain, and such structure can be obtained by copolymerization with the following comonomers.

$CF_2{=}CF{-}O{-}CF_2CF(CF_3){-}O{-}CF_2CF_2SO_2F$, $CF_2{=}CF{-}O{-}CF_2CF_2CF_2COOCH_3$, $CF_2{=}CF$'3$CF_2CF\ (CF_3){-}O{-}CF_2CF_2SO_2F$

As a suitable water repellent having a specific chemical structure as above shown, Cytop CTX-105 (trade name, made by Asahi Glass) or Cytop CTX-805 (trade name, made by Asahi Glass), or Teflon AF (trade name, Du Pont) can be cited.

It should be noted that in the present invention, the method of forming a water-repellent film with a polymer having a specific ring structure can be largely divided into two classes, depending on the process of manufacturing the head.

That is, there are the type of forming discharge ports after the water-repellent layer is formed, and the type of forming the water-repellent layer after discharge ports are formed. The former can be created by immersion into an original or diluted solution of a polymer having a specific structure in the present invention, or with a general coating method such as the transfer with an absorbing medium, spraying or spin coat. The latter must be provided with some measures for preventing the water repellent from passing into an internal wall face of ink channel from a discharge port, which may occur with the former method. For example, measures must be taken, such as transferring with a silicone rubber, or prefilling liquid or solid not mixing with the water repellent in liquid channels, or performing the water-repellent treatment while spraying the gas through nozzles. Such arts are disclosed for example in Japanese Laid-Open Patent Application No. 63-122557, Japanese Laid-Open Patent Application No. 63-239063 and Japanese Laid-Open Patent Application No. 2-48953.

The solvent to be used is not limited if it can dissolve the polymer of the present invention, but preferably a fluorine solvent, such as perfluorobenzene, "Aflude" (trade name: fluorine solvent made by Asahi Glass), "Florinate FC-75" (trade name: liquid containing Perfluoro (2-butyltetrahydrofuran) made by 3M). Naturally, two or more kinds can be suitably mixed as a solvent. Especially, in a mixed solvent, hydrocarbon, hydrocarbon chloride, hydrocarbon fluorochloride, alcohol, and other organic solvents can be used together. The density of solution is 0.01wt % to 50 wt %, and preferably 0.01 wt % to 20 wt %.

In the present invention, if the thickness of a water-repellent film composed of compounds specific to the present invention is above 0.1 μm, the objects as previously described can be sufficiently accomplished, but preferably within a range of 0.1 to 2 μm.

In the present invention, the thermal treatment condition (temperature) for a fluorine polymer having a specific hetero structure can be determined by a boiling point of solvent, glass transition point of such polymer, and the heat resisting temperature of base material. That is, it should be selected at a temperature higher than the boiling point of solvent and the glass transition point of such polymer, and lower than the heat resisting temperature of base material.

The glass transition point of such polymer is different depending on its structure. For example, the structure having the general expressions ⑥ to ⑧ as previously described, is mostly at a temperature of 50 to 110° C., and the heat treatment condition is preferably such that the temperature is 120° to 170° C., and the time is 30 min. to 2 hours. Also, a copolymer having the structure of ② and the structure $$\leftarrow CF_2-CF_2 \rightarrow$$

is marketed under a trademark of "Teflon AF" by Du Pont. The Teflon AF can have various glass transition temperatures by changing the ratio of copolymerization. That is, the higher the ratio of PDD [Perfluoro (2, 2-dimethyl-1, 3-dioxole)] component, the higher the glass transition point. It exists in a range of 80° to 330° C. depending on the component ratio, and those for 160° C. (AF1600) and 240° C. (AF2400) are marketed. For example, the heat treatment temperature for that of 160° C. is preferably in a range of 165° to 180° C. in view of the heat resisting temperature of base material.

DESCRIPTION OF THE PREFERRED EMBODIMENTS

The examples of the present invention will be described in detail with reference to the drawings.

The present invention discloses an art for applying an excellent water-repellent treatment at least in peripheries of discharge ports in a discharge port formation face.

Figure 1A:
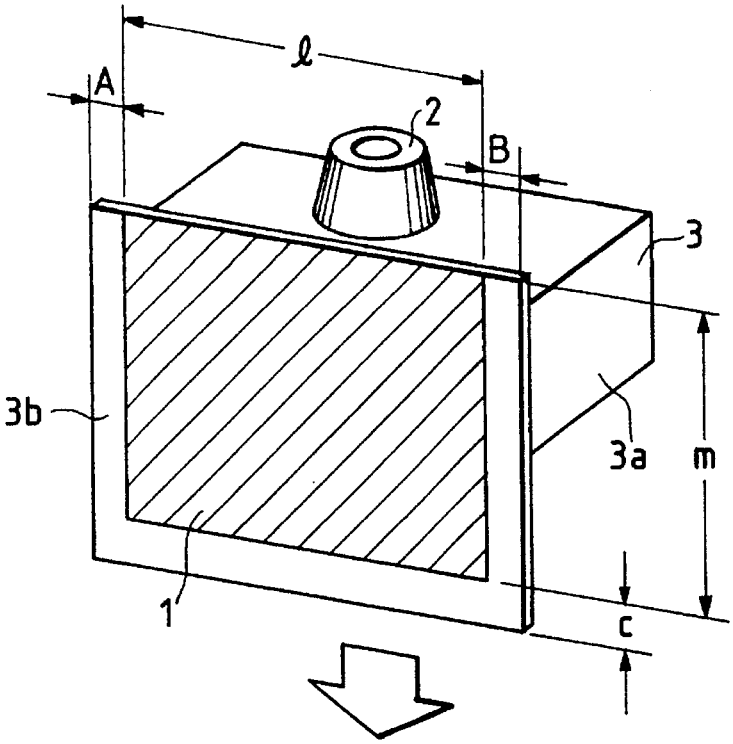
FIGS. 1A and 1B are perspective views schematically showing a ceiling plate integral with a grooved substrate for orifice plate constituting a recording head according to the present invention.
Figure 1B:
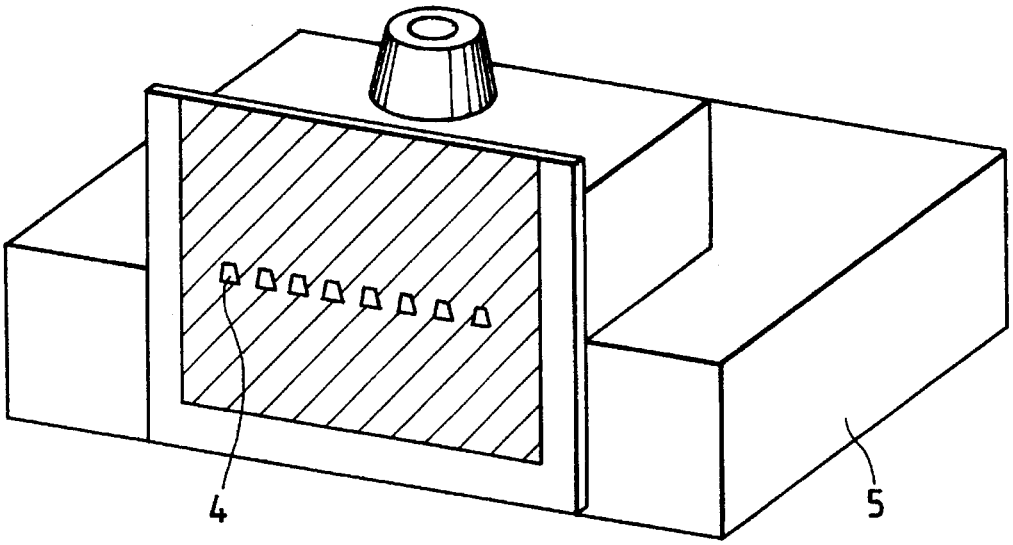

FIG. 1 is a typical perspective view showing a recording head in one example of the present invention. This recording head is constructed by joining a grooved ceiling plate 3 having integrally a substrate *3a* provided with grooves (concave portions) used for a common liquid chamber and liquid channels and an orifice plate *3b* on which discharge ports are provided, and a substrate 5 having heating resistors for generating the thermal energy useful for discharging the ink provided corresponding to the liquid channels.

The manufacturing process of this recording head, especially the water-repellent process on the grooved ceiling plate, can be generally performed via ① the first process of creating the grooved ceiling plate, ② the second process of applying the pretreatment according to the present invention, ③ the third process of constituting a water-repellent layer with a water repellent according to the present invention, ④ the fourth process of boring discharge ports by the use of a laser beam and ⑤ the fifth process of applying the after-treatment according to the present invention. Among these processes, all of the second, third and fourth processes are most preferably performed in the water-repellent treatment process, but with any one or a combination of these processes, the improvement of characteristics in the water-repellent layer can be expected sufficiently.

In the present invention, firstly, the water repellent in connection with the third process was examined. The examples will be described below.

EXAMPLE 1

After creating a grooved ceiling plate integral with an orifice plate and a substrate by the use of the injection molding method, a mold releasing agent sticking to the grooved ceiling plate was cleaned in an ultrasonic cleaning bath. Next, for that grooved ceiling plate, the water-repellent treatment was applied. Using a 5% solution of Cytop CTX-105 (trade name: made by Asahi Glass) as the water repellent, the solution diluted to 0.5 wt % with CT-solv.100 (having a boiling point of 100° C., made by Asahi Glass), was used.

The application of the water repellent onto the orifice plate was performed in such a way as to cut Belletta F mesh (made by Kanebo) of absorbing medium into a predetermined size, dipping that absorbing medium in the water repellent, and moving that withdrawn medium while pressing it onto a discharge port formation face of the cleaned grooved ceiling plate.

The coating range of water repellent (1 xm in FIG. 1) can be determined by the width and the moving distance of absorbing medium. Then, the width of absorbing medium was cut in a dimension 0.2 mm shorter than that necessary for the water repellent. This is because the spreading of water repellent itself (about 0.1 mm in both directions) exists in the coating. The moving distance is equal to a dimension (m in FIG. 1) other than a portion not applied by the absorbing medium.

Here, the fact that the coating range is not a whole area of discharge port formation face but a certain specified area thereof is based on a reason for preventing the water repellent from turning aside at the coating and the heat treatment. In this case, symbols A, B and C in FIG. 1 were all 0.5 mm. But if there is no fear of turning aside, A, B and C can be 0.

The ceiling plate that has been coated is placed in a tray, and submitted to an oven at 150° C. for two and half hours for the heat treatment. Then, as it takes first 30 minutes after submission for the temperature of grooved ceiling plate and tray to rise up to a predetermined temperature of 150° C., the actual heat treatment time is two hours.

It was cooled gradually after two and half hours, and taken out from the oven at a point when it was below 80° C. For the grooved ceiling plate which had-been treated with the water repellent, discharge orifices were formed by the use of an excimer laser, and pasted with the substrate having discharge pressure generating elements.

EXAMPLE 2

A mold releasing agent of the grooved ceiling plate was cleaned, and then the coating was applied using the same absorbing medium and in the same method as in the example 1. Using a 5 wt % solution of Cytop CTX-805 (trade name: made by Asahi Glass) as the water repellent, the solution diluted to 0.5 wt % with CT-solv.100 (boiling point 100° C., made by Asahi Glass), was used.

This solvent has a boiling point of 180° C., but polysulfone, which is a material for the grooved ceiling plate, has a heat resisting temperature of near 173° C., so that the heat treatment temperature was set to be 150° C. and the time to be two and half hours.

It was cooled gradually after two and half hours, and taken out from the oven at a point when it was below 80° C. For the grooved ceiling plate which had been treated with the water repellent, discharge orifices were formed by the use of an excimer laser, and pasted with a substrate having discharge pressure generating elements.

EXAMPLE 3

A mold releasing agent of grooved ceiling plate was cleaned, and then the coating was applied using the same absorbing medium and in the same method as in the example 1. As the water repellent agent, a solution of AF1600 (Teflon AF, trade name: made by Du Pont) diluted to 0.5 wt % with Florinate FC-75 (trade name, made by 3M) was used. As the glass transition point of AF1600 is at 160° C., the heat treatment condition was set at 165° C. and for two and half hours.

It was cooled gradually after two and half hours, and taken out from the oven at a point when it was below 80° C. For the grooved ceiling plate which had been treated with the water repellent, discharge orifices were formed by the use of an excimer laser, and pasted with a substrate having discharge pressure generating elements.

As the water repellent, instead of AF1600 as above, AF2400 having a higher glass transition point (Teflon AF, trade name made by Du Pont) diluted to 0.5 wt % with Florinate FC-75 (trade name, made by 3M) can be used to attain the same performance. The heat treatment condition is the same as above. However, if the heat resisting temperature of the substrate is high, the performance is further increased with raised heat treatment temperature.

EXAMPLE 4

In this example, a recording head was used in which a grooved ceiling plate without orifice plate was only joined to a substrate. A multi-nozzle head of the type having performed discharge ports was first formed. Next, external wall surfaces of discharge ports were cleaned well with the distilled water, and subsequently cleaned with an organic solvent.

As the water repellent, AF2400 (Teflon AF, trade name, made by Du Pont) diluted to 0.5 wt % with florinate FC-75 (trade name, made by 3M) was used.

The formation of a water-repellent layer using the water repellent was performed as in the following. First, silicone rubber was laid on a spinner, and that solution of 2 cc was dropped on the silicone rubber. After dropping, it was rotated on the spinner to form a uniform film. The rotation frequency was set to be first 1000 rpm for five seconds, and second 3000 rpm for 20 seconds.

An orifice face of the above multi-nozzle head was pressed against the silicone rubber for the transfer. The pressing was made three times at a pressure of 2 kg/head.

After completion of the transfer, the entire head was submitted into an oven at 165° C. for two and half hours, for the heat treatment. When using AF2400 (Telfon AF, trade name, made by Du Pont) as the water repellent, the transfer can be performed in the same condition.

COMPARATIVE EXAMPLE 1

A mold releasing agent of the grooved ceiling plate was cleaned, and then the coating was applied using the same absorbing medium and in the same method, as in the example 1. As the water repellent, a 3 wt % solution of KP801 (trade name: made by The Shin-Etsu Chemical Co., Ltd.) diluted to 1 wt % with Flon 113 (Dyflon S3, made by Daikin Kogyo Co., Ltd.) was used.

The heat treatment condition was set at 150° C. and for two and half hours, as in the above example. It was cooled gradually after two and half hours, and taken out from the oven at a point when it was below 80° C. For the grooved ceiling plate which had been treated with the water repellent, discharge orifices were formed by the use of an excimer laser, and pasted with a substrate having discharge pressure generating elements.

Next, in order to investigate the performance of water-repellent property with the ink jet recording head which has been processed with a specific polymer, the coating property, the initial characteristics, and the contact angle persistence with respect to the base material were evaluated. The contents are shown in the following.

Contents of evaluation (1) Coating property onto a base material

① Coating property→presence or absence of coating unevenness.

(Using a Belletta of absorbing medium)

(2) Initial characteristics

① Initial contact angle→contact angle (advanced and retracted)

② Adhesion→presence or absence of exfoliation in the peel test (Using a capping tape)

(3) Contact angle persistence

③ Abrasion resistance→variation of advanced and retracted contact angle (Using a rubbing condurance tester, 2000 times)

② Ink dipping test→variation of advanced and retracted contact angle (60° C.)

③ PCT (pressure cracker test)→variation of advanced and retracted contact angle (Check at 120° C., 2 atm, after 10 hours while dipping into the ink)

(4) Evaluation of print

The probabilities that the deflection of dot might occur were compared visually, by printing consecutively the character of an alphabet "H" in an environment of 80 % RH at 30° C.

The deflection of print was defined to be present if there was any deflection in an A4-size sheet, and how many sheets per 100 sheets had the deflection was examined.

The evaluation results are shown in Table 1.

In the example 1, quite excellent results could be obtained in all items. Also, in the example 2, there were some cases where irregularities might arise during the application, but as to the durability, excellent results could be obtained.

The measuring method of contact angle which is point issue in evaluating the above items will be described below.

The contact angle usually described in catalogues is one referred to as an advanced contact angle.

Figure 2A:
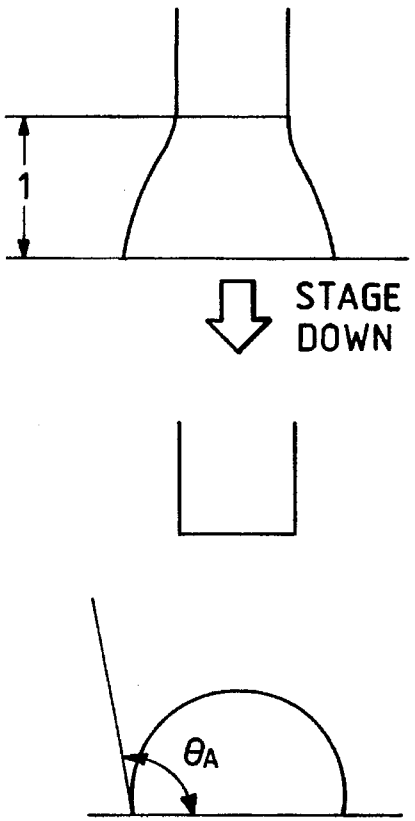
FIGS. 2A, 2B and 2C are views for explaining the measuring method of a contact angle for the liquid.

The measurement is performed by dropping the ink, lowering a stage down, and reading the angle of separated liquid droplet, as shown in FIG. 2A.

Figure 2B:
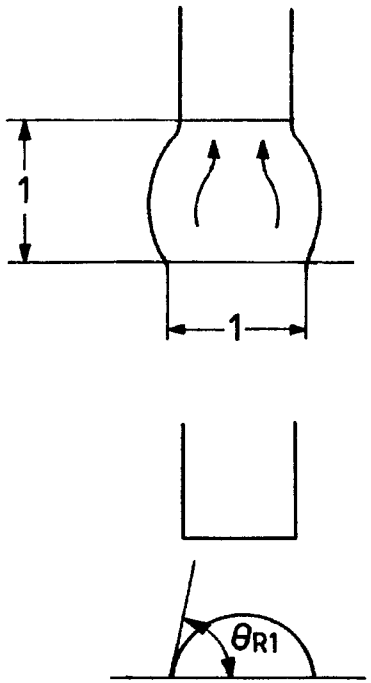
Figure 2C:
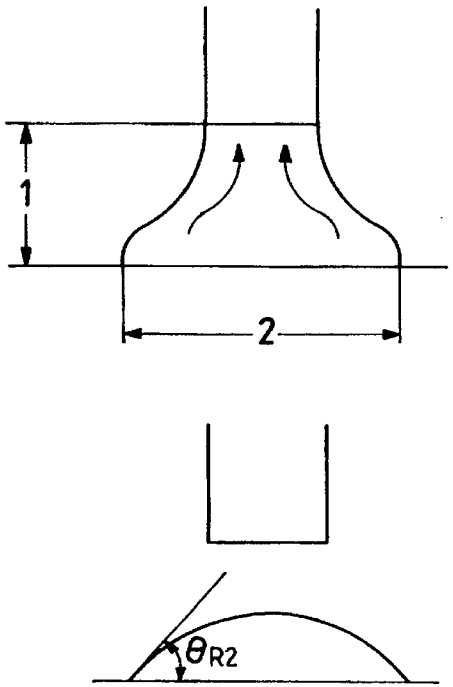

On the contrary, in the evaluation of water-repellent property of an ink jet recording head, the retracted contact angle was used. This is performed by dropping the ink at a time, sucking the ink after wetting, and then measuring the angle of remaining liquid droplet, as shown in FIGS. 2B and 2C. Here, the retracted contact angle was measured by $\theta_{R1}$ and $\theta_{R2}$ depending on the amount (quantity) of ink initially delivered. A conventional retracted contact angle is one as indicated by $\theta_{R1}$. When $\theta_{R1}$ and $\theta_{R2}$ are compared, $\theta_{R2}$ is placed in a severer condition, so that the difference between water-repellent properties is likely to appear, which is effective for the evaluation.

Figure 3:
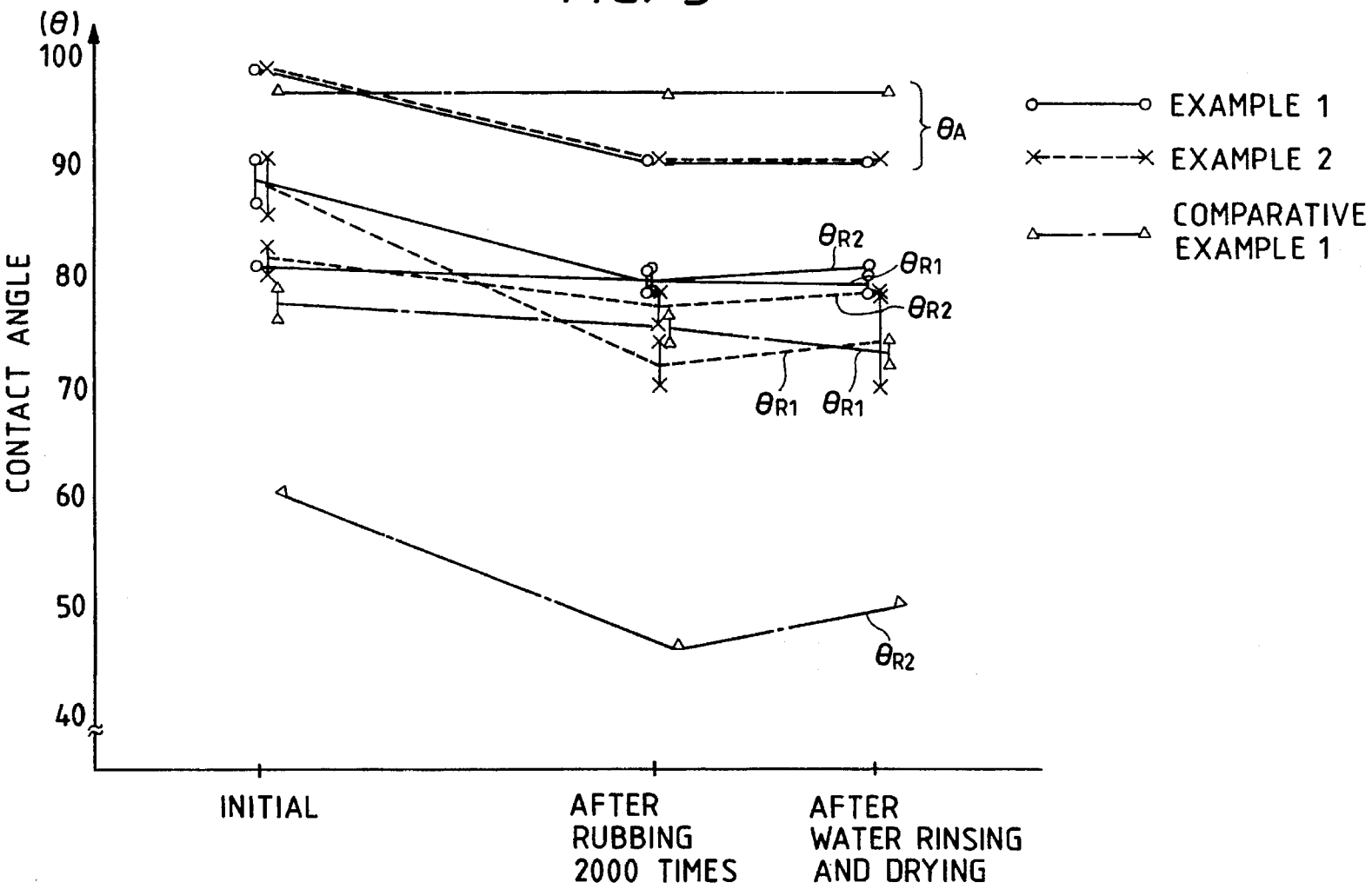
FIG. 3 is a characteristic diagram showing results of the rubbing durability test.
Figure 4:
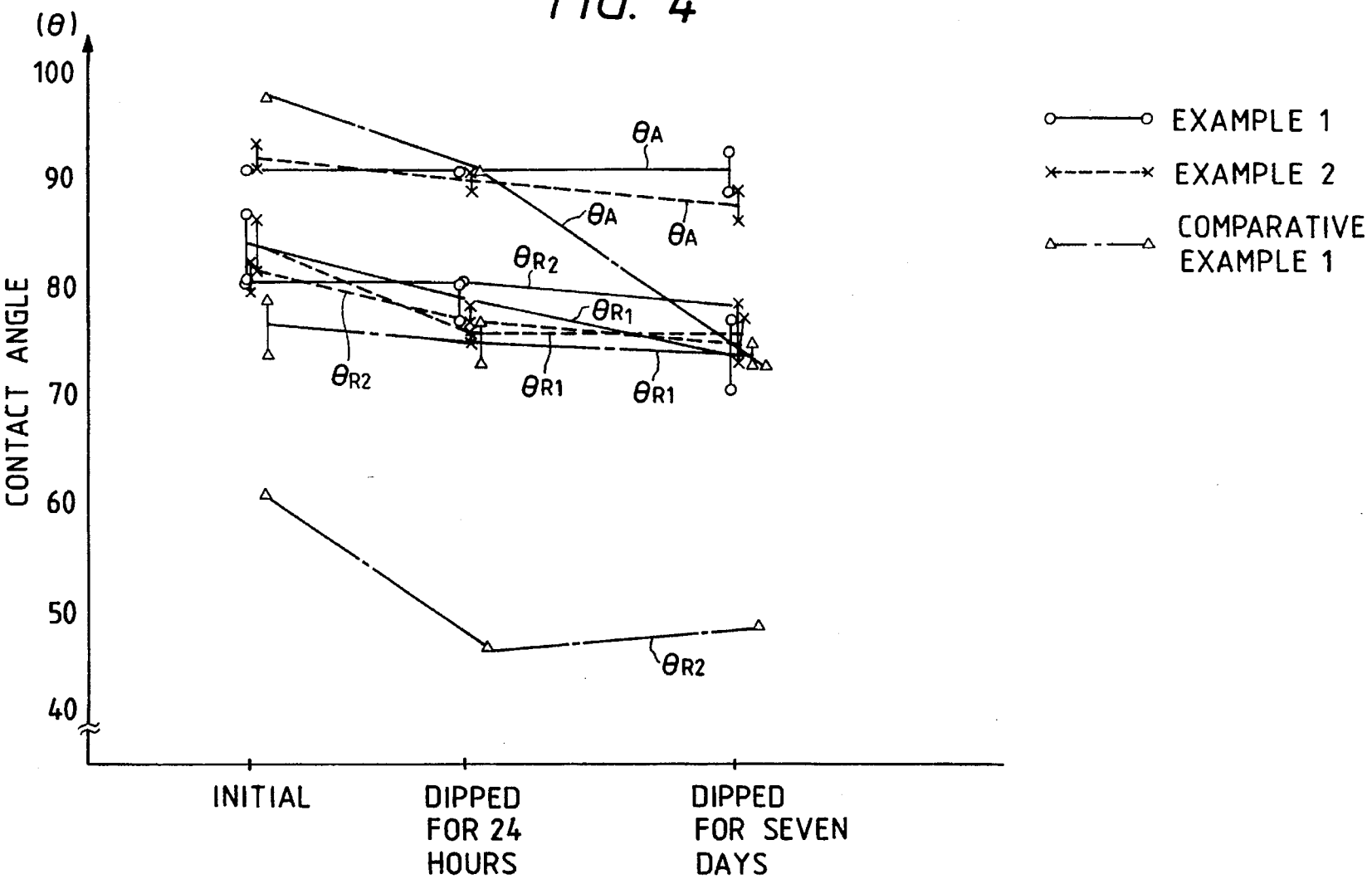
FIG. 4 is a characteristic diagram showing results of the ink dipping test.
Figure 5:
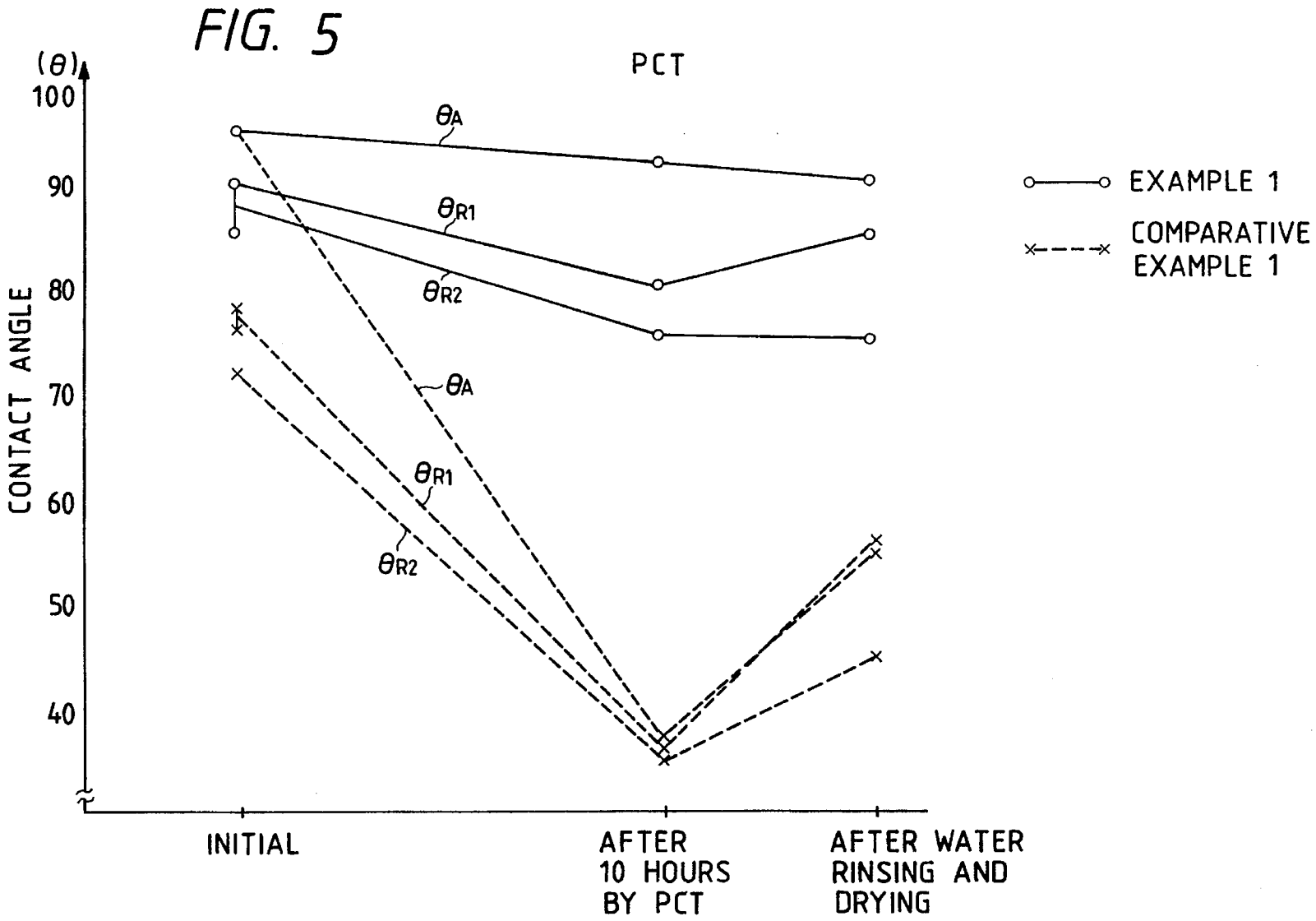
FIG. 5 is a characteristic diagram showing results of the PCT test.

The comparative results with the measuring method of retracted contact angle as above described are shown in FIGS. 3 to 5.

In the rubbing endurance test of FIG. 3, there is no difference between the example and the comparative example with the conventional measuring method $\theta_A$, but a large difference was seen in data of $\theta_{R2}$. Also, in the ink dipping test of FIG. 4, the examples 1 and 2 showed stable excellent results, but in the comparative example 1, the decrease of contact angle was seen with $\theta_A$ (advanced contact angle). Moreover, when PCT was applied while dipping into the ink as shown in FIG. 5, a large difference was seen between the example 1 and the comparative example 1, irrespective of the measuring method of contact angle.

Though the comparative results between the examples 1 and 2 and the comparative example 1 were shown as above, excellent performances of the same level were also shown in connection with the examples 3 and 4.

As above shown, the discharge observation and the print test with an ink jet recording head treated with the water repellent having a superior performance according to the present invention, indicated that the ink could be stably discharged in a predetermined direction at all times, even in the condition where a head not treated or treated by a conventional method might cause unstable flying direction or undischarge, i.e., where all nozzles (64 or 128 nozzles) are driven at the same time at a discharge signal application frequency of 4 KHz. Also, printed results were good without

TABLE 1

| | Coating | Initial characteristics | | Persistence of contact angle | | | | |
|---|---|---|---|---|---|---|---|---|
| | property to base material | Initial contact angle | Peel test | Abrasion resistance (20000 times) | Dipping ink (60° C., 7 days) | PCT (10 hr) | Evaluation of print deflec. | Total evaluation |
| Examp. 1 | ⊙ | ⊙ | ○ | ⊙ | ⊙ | ⊙ | 1% | ⊙ |
| Examp. 2 | ○ | ⊙ | — | ⊙ | ⊙ | — | 2% | ○ |
| Comparative examp. 1 | ○ | ⊙ | ○ | Δ | ○ | ○ | 6% | Δ |

problems such as deflection of vertical line or void of solid printing.

In this example, the water repellent of the present invention is formed as a solid film before formation of orifice in an orifice plate, so that the water repellent applied does not enter into the orifice to disturb the discharge characteristics, and the water repellent is applied in a state of dissolving in the solvent, so that a proper curved surface can be also formed for a stepped portion of minute step configuration as above, to improve the cleaning or capping ability, and to be able to expand the permissible range of numerical configuration as above. And its water-repellent surface was even and smooth by virtue of the use of amorphous polymer having a fluorine hetero ring structure of the present invention, so that more excellent effects could be exhibited than the conventional recording head.

Further, the cleaning reliability in wiping could be further improved by constituting a surface on the side in which discharge ports of the orifice plate are provided as a stepped side cross-sectional shape having a moderate slope.

Further, in the present invention, by providing a film containing a polymer having the fluorine hetero ring structure in the principal chain as the water-repellent layer, the improvement of its characteristics was sought, and further, by performing a surface treatment for the orifice plate in the pretreatment for providing the water-repellent layer, it is possible to improve the coupling characteristics of the water repellent, and further improve the characteristics of the water-repellent layer.

An example in which the pretreatment is applied will be described below.

EXAMPLE 5

A hydrophilic oxidation treatment layer was provided by oxidizing with a potassium bichromate having an oxidation power at least in peripheries of region where dischage ports are to be formed in a grooved ceiling plate provided with an orifice plate made of polysulfone superior in the ink resisting property.

Next, after dipping the grooved ceiling plate treated with the potassium bichromate as above or the ultraviolet rays radiation ozone cleaning in an amine silane coupling agent (e.g., A1110 γ-aminopropyltrimethoxysilane made by Japan Konika), excess silane coupling agent was removed in the pure water, and a monomolecular layer of uniform silane coupling agent was formed in peripheral portions of orifices.

Next, a sample treated with silane was air dried and then treated with the water repellent. As the water repellent, an original solution (5 wt %) of CTX-805A (made by Asahi Glass Co., Ltd.) or CTX-105A (same to left) diluted with CT-Solv100:CT-Solv180 (having boiling points of 100° C. and 180° C., respectively, both made by Asahi Glass Co., Ltd.)=4:1 was used. The concentration in a range from 0.01 to 5.0 wt % can be used, particularly 0.1 to 0.7 wt % is optimal. The coating of head can be made with the brushing or cast method. Next, the thermal drying treatment was performed at 150° C. for 1 hour. Thereafter, discharge orifices were formed by boring with a laser beam, and a substrate having discharge pressure generating elements was pasted. The head made in such a way was prepared as sample 1.

EXAMPLE 6

A hydrophilic oxidation treatment layer was provided by cleaning with the ultraviolet rays radiation ozone having an oxidation power at least in peripheries of region where discharge ports were to be formed in an orifice plate.

Next, as in the example 5, an intermediate monomolecular layer with a silane coupling agent was formed. Note that the process of cleaning with pure water was omitted in this example.

Next, using the same water repellent as in the example 5, boring with the laser beam was made to prepare sample 2.

COMPARATIVE EXAMPLE 2

An ink jet recording head was fabricated in the same way as in the example 1, with the exception that the silane coupling agent treatment was not made. Such a head was prepared as sample 3.

Evaluation of durability

For the samples 1 to 3 of ink jet recording head fabricated in the examples 5 and 6, and comparative example 2, the abrasion resisting test was performed.

Figure 6A:
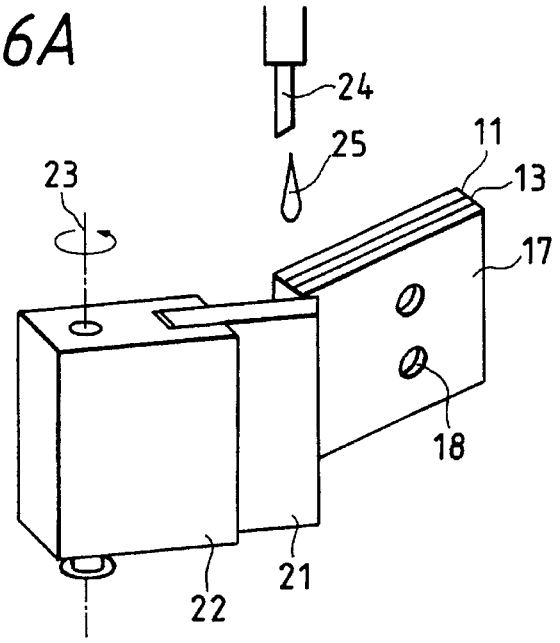
FIGS. 6A and 6B are views schematically showing the test method for the cleaning durability test for a recording head.
Figure 6B:
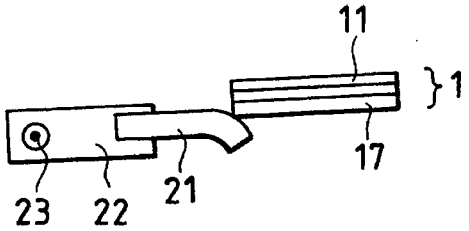

FIGS. 6A and 6B are a perspective view and a plan view showing the outline of the abrasion resisting test.

As shown in this figure, a silicon rubber plate 21 can rub on a surface treatment layer 20 of ink jet recording head 1 at a pressure of about 10 g/cm$^2$, along with the rotation of a member 22. In order that the rubbing may be made in a state close to the actual utilization state, ink droplets 25 of water-color ink can be sprayed onto rubbing portions from an ink spray apparatus 24.

Using that apparatus, the durability test was made 1,000 to 20,000 times, with the frequency of ink spray being once per 10 seconds. In doing so, the head was removed after each of 1,000 times, 5,000 times, 10,000 times and 20,000 times, and printed conditions were observed. The results are shown in Table 2. Note that each mark shown in Table 2 indicates the state of print obtained, in which ○ indicates that the print condition is excellent, Δ indicates that the print condition is ordinary, and x indicates that the print condition is bad. The judgement as to whether the print condition is good or not is based on both the measurement of the amount of shift on the impacting point of dot, and the visual organoleptic test, in which the average evaluation of each sample is shown in Table 2.

TABLE 2

| | Sample 1 | Sample 2 | Sample 3 |
|---|---|---|---|
| 1,000 | ○ | ○ | ○ |
| 5,000 | ○ | ○ | x |
| 10,000 | ○ | Δ | — |
| 20,000 | ○ | Δ | — |

○ . . . excellent Δ . . . ordinary x . . . bad

As can be clearly seen from the results in Table 2, a recording head (sample 3) in the comparative example 2 is shown as bad in the print condition after 5,000 rubbings. This is because the surface treatment layer may be exfoliated. On the contrary, the head (sample 1, 2) in the examples 5 and 6 was excellent or ordinary in the print condition even after 20,000 rubbings. Especially, by comparison between sample 1 and sample 2, the sample 1 treated with the rinsing was stabler in the print quality after 20,000 rubbings.

In this way, by providing an intermediate layer with the silane coupling agent after the oxidation treatment for a substrate, the oxygen on a surface of the substrate and the silane coupling can be chemically strongly bonded. And the end group of silane coupling agent and that of the water repellent in the next process are chemically bonded stably and strongly, so that the improvement of durability in the water-repellent layer can be attained.

In this example, a Si coupling agent was used as the intermediate layer, but using an organic metal compound, an amine resin, or an amine curing resin as having the same function, a strong bonded state between the substrate and the water repellent can be achieved by providing the layer containing them as the intermediate layer.

In the present invention, when discharge ports are formed by using a laser beam after making the water-repellent treatment for a grooved ceiling plate in which an orifice plate and a grooved substrate are integrally formed, it has been found that byproducts resulted from the laser beam may stick to peripheries of discharge ports. As the sticking of such byproducts may bring about the decrease of ability in the water-repellent layer, the water repellent ability is further favorable and the quality of print can be stably obtained in a long term, by taking some measures for such byproducts.

In the following, an example is shown in which the after-treatment is applied after forming discharge ports with the laser beam machining.

EXAMPLE 7

First, the formation of discharge ports with a laser beam will be described schematically.

Figure 7:
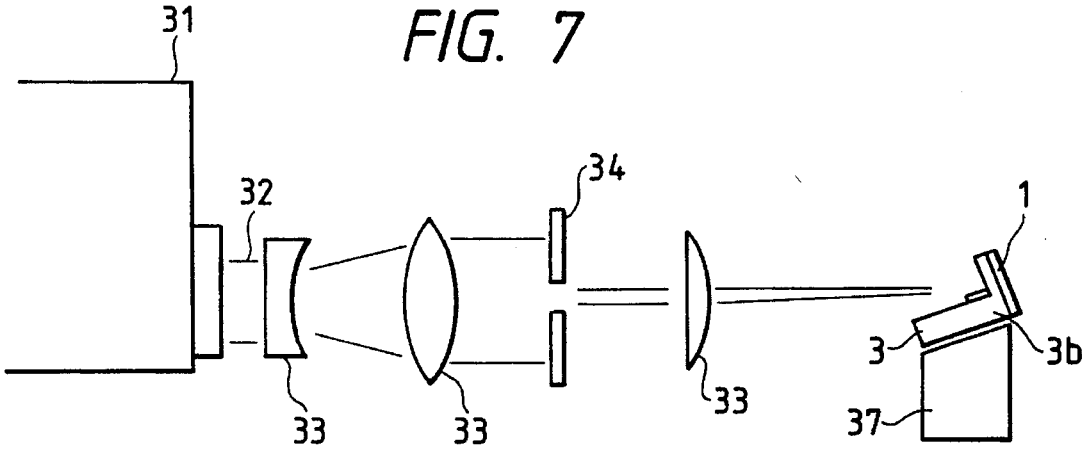
FIG. 7 is a schematic apparatus view for forming discharge ports with the laser beam machining.

FIG. 7 shows how the orifice machining is performed by radiating an orifice plate formed integrally with a ceiling plate and having a water-repellent layer formed thereon, with a excimer laser beam, from the side of ink liquid channels. In the same figure, 31 is a laser oscillator for oscillating a KrF excimer laser beam, 32 is a pulsed laser beam having a wavelength of 248 mm and a pulse width of about 15 nsec, oscillated from the laser oscillator 31, 33 is a synthetic quartz lens for focusing the laser beam 32, and 34 is a projection mask on which aluminum shielding against the laser beam 32 has been deposited, in which a plurality of bores having a diameter of 133 μm at a pitch of 212 μm are disposed to make an orifice pattern.

36 is an orifice plate having a water-repellent layer 1. The laser beam 32 oscillated from the excimer laser 31 is processed by an optical system 33, to radiate the projection mask 34 having all or a part of orifices in an ink jet recording head. This optical system projects the pattern of projection mask 34 at a magnitude of ⅓ to form discharge ports in the orifice plate **3*b* having the water-repellent layer 1. In this example, the orifice plate 3*b* used a film of polyethersulfone (PES). Also, the water repellent used Cytop (trade name, made by Asahi Glass Co., Ltd. Tg=108° C.), in which after coating Cytop onto the orifice plate of PES, the water-repellent layer 1 was formed after the heat treatment for one hour at 120° C. This orifice plate 1*b* was processed for orifice by an orifice machining apparatus as shown in FIG. 7**.

Figure 8:
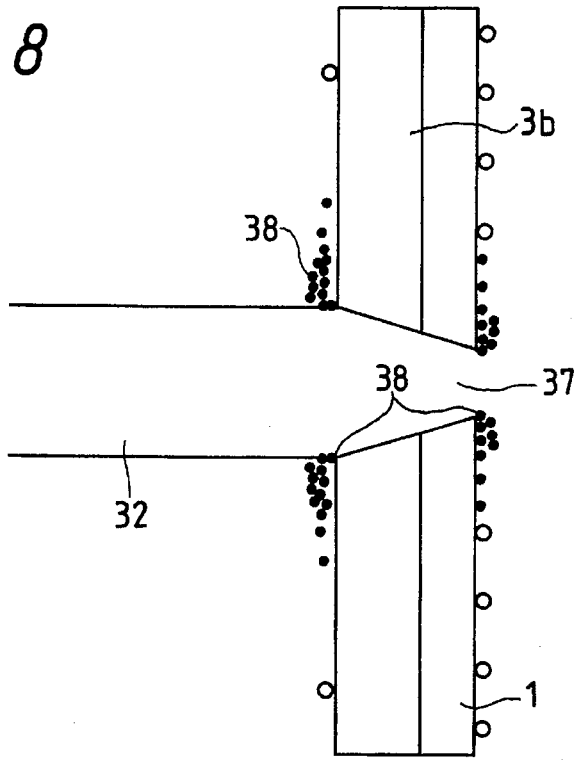
FIG. 8 is a typical view, partially enlarged, showing the state of an orifice plate immediately after the laser beam machining.

FIG. 8 shows the orifice plate **3*b* as shown in FIG. 7 in a larger scale. In the same figure, 32 is an excimer laser beam, 3*b* is an orifice plate, 1 is a water-repellent treatment layer, 37 is a discharge opening formed by the orifice machining apparatus, and 38 is byproducts yielded during the orifice machining and sticking to the neighborhood of orifice. In this example, to form the discharge opening 37, the laser beam 32 is entered from a face not having the water-repellent treatment layer 1 of the orifice plate 3*b***.

Figure 9:
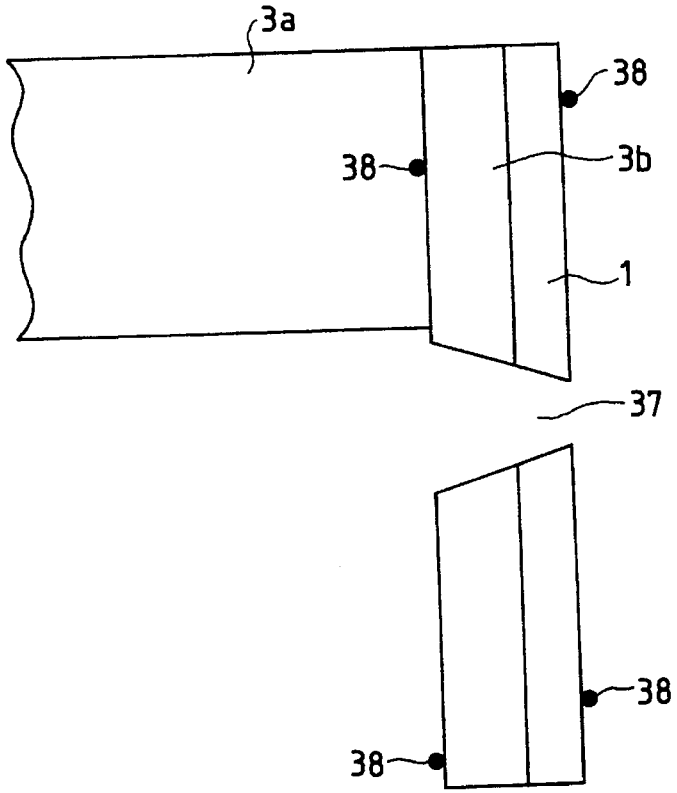
FIG. 9 is a typical view, partially enlarged, showing the state of the orifice plate after the after-treatment according to the present invention.

In this way, a grooved ceiling plate integral with the orifice plate having byproducts sticking to and deposited in the neighborhood of discharge opening by the orifice machining was heat treated at 120° C. for one hour, and an ink jet recording head was fabricated using that plate. The state of the orifice plate after the heat treatment is shown in FIG. 9, in which almost any byproducts adhering to peripheral portions of discharge opening are not seen.

EXAMPLE 8

In this example, the orifice plate **3*b* used a film of polyethersulfone. Also, the water repellent used KP801 (trade name, made by The Shin-Etsu Chemical Co., Ltd. ), and after coating it onto the orifice plate 3*b*, a water-repellent layer was formed by making the heat treatment at 150° C. for one hour. For the orifice plate 3*b* having the water-repellent layer 1 formed in this way, discharge ports were formed by radiating it with a KrF excimer laser beam from the side opposite to the water-repellent layer formed therein. An recording head was fabricated by processing the orifice plate 3*b* having the discharge ports 37** formed in this way, with the ultrasonic cleaning in water.

EXAMPLE 9

In this example, the orifice plate 5 used a film of polyimide. Also, the water repellent used KP801 (trade name, made by The Shin-Etsu Chemical Co., Ltd.), and after coating it onto the orifice plate **3*b*, a water-repellent layer 1 was formed by making the heat treatment at 150° C for one hour. For the orifice plate 3*b* having the water-repellent layer 1 formed in this way, discharge ports 37 were formed by radiating it with an XeCl excimer laser beam from the side opposite to the water-repellent layer formed therein. A recording head was fabricated by processing the orifice plate 3*b* having the discharge ports 37** formed in this way, with the ultrasonic cleaning in pure water.

EXAMPLE 10

In this example, the orifice plate 5 used a film of polyethersulfone. Also, the water repellent used Cytop (trade name, made by Asahi Glass), and after coating it onto the orifice plate 5, a water-repellent layer 6 was formed by making the heat treatment at 120° C. for one hour. For the orifice plate 5 having the water-repellent layer 6 formed in this way, orifices were formed by radiating it with a KrF excimer laser beam from the side opposite to the water-repellent layer formed therein. A high pressure water flow, which was formed by continuously discharging pure water pressurized to 200 kgf/cm$^2$ through the nozzles of 50 micron formed of sapphire, was directed to the orifices 7 formed in the orifice plate 5 in this way. Thereby, byproducts 8 from the laser machining where the high pressure water flow was not applied could not be sufficiently removed, but byproducts from the laser machining sticking to the neighborhood of discharge ports in the orifice plate could be removed.

EXAMPLE 11

In this example, the orifice plate 5 used a film of polyimide. Also, the water repellent used KP801 (trade name, made by Shin-Etsu Chemical Co., Ltd.), and after coating it onto the orifice plate 5, a water-repellent layer 6 was formed by making the heat treatment at 150> C. for one hour. For the orifice plate 5 having the water-repellent layer 6 formed in this way, orifices 7 were formed by radiating it with an XeCl excimer laser beam from the side opposite to the water-repellent layer formed therein. On both sides of the orifice plate 5 having the orifices 7 formed in this way, pasting and peeling of cellophane tape was repeated each five times. A recording head was fabricated using it.

COMPARATIVE EXAMPLE 3

As a comparative example, discharge ports were formed by means of the laser beam machining as in the previous examples 7 to 11, and a recording head was fabricated using an orifice plate having byproducts adhering thereto without the after-treatment.

Using a recording head processed with the after-treatment and a recording head not processed with the after-treatment, the recording state was observed by mounting it onto an apparatus and repeating a predetermined recording (recording of character and solid printing pattern). The results are shown in Table 3.

TABLE 3

| Number of sheets | Examp. 7 | Examp. 8 | Examp. 9 | Examp. 10 | Examp. 11 | Comparative example |
|---|---|---|---|---|---|---|
| 50 | ◎ | ◎ | ◎ | ◎ | ◎ | ◎ |
| 100 | ◎ | ◎ | ◎ | ◎ | ◎ | ○ |
| 300 | ◎ | ◎ | ◎ | ◎ | ○ | Δ |
| 500 | ◎ | ◎ | ○ | ○ | Δ | x |

◎: no degradation
○: almost no degradation
Δ: discharge unevenness (deflection)
x: discharge unevenness, undischarge As will be apparently seen from Table 3, the recording head of this example is stable in a long term, indicating the discharge state superior in durability. That is, byproducts from the laser beam boring can be removed well, exhibiting the function of water-repellent layer sufficiently.

Here, the present inventors have found that byproducts on the water-repellent layer are deposits of about 10 Å from very minute spherical grains of polysulfone, each 3 to 4Å, as a result of further examination for byproducts yielded in the laser beam machining of the orifice plate 1 made of polysulfone and having the water-repellent layer formed as Cytop.

Figure 10:
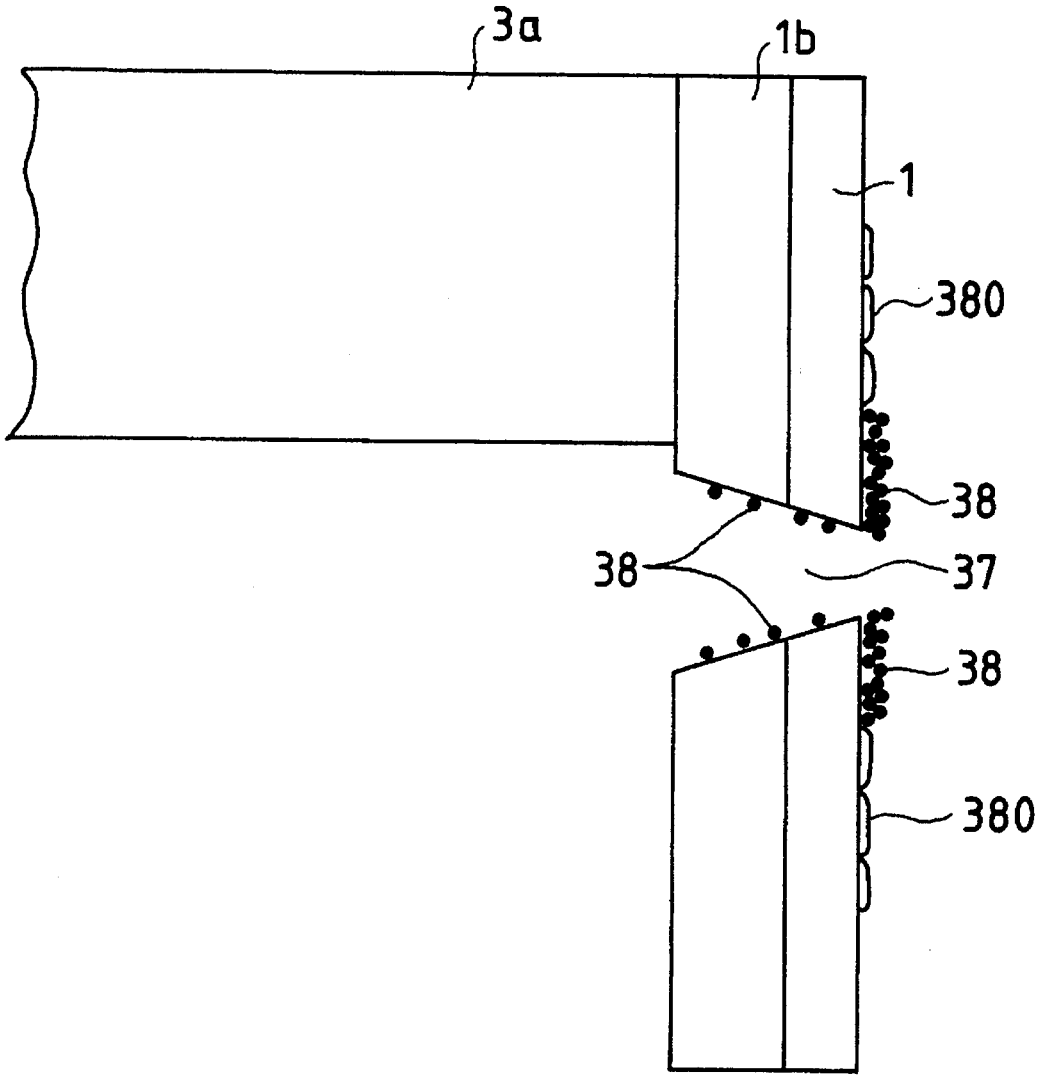
FIG. 10 is a view showing the detail of the orifice plate immediately after the laser beam machining.

Such particularly minute polysulfone spherical grains 38 may stick to peripheral portions of discharge ports, and plate-like sticking matters 380 of polyolefine were found in places away from discharge ports. Also, small amount of minute grains of polyolefine were observed sticking to discharge opening portions of the orifice plate. This concept view is shown in FIG.10.

The after-treatments for those sticking matters (byproducts) in previous examples were examined, and it has been found that the heat treatment as shown in example 7 is effective among them. This treatment is one of forming for water-repellent surface owing to a phenomenon of decreasing the viscosity of water repellent by heating, moving it between byproducts on the water-repellent layer by the capillary action, and covering the surface of byproducts.

That is, the heat treatment is not to remove byproducts, unlike other examples, but to cover the most upper surface with the water repellent securely.

Figure 11:
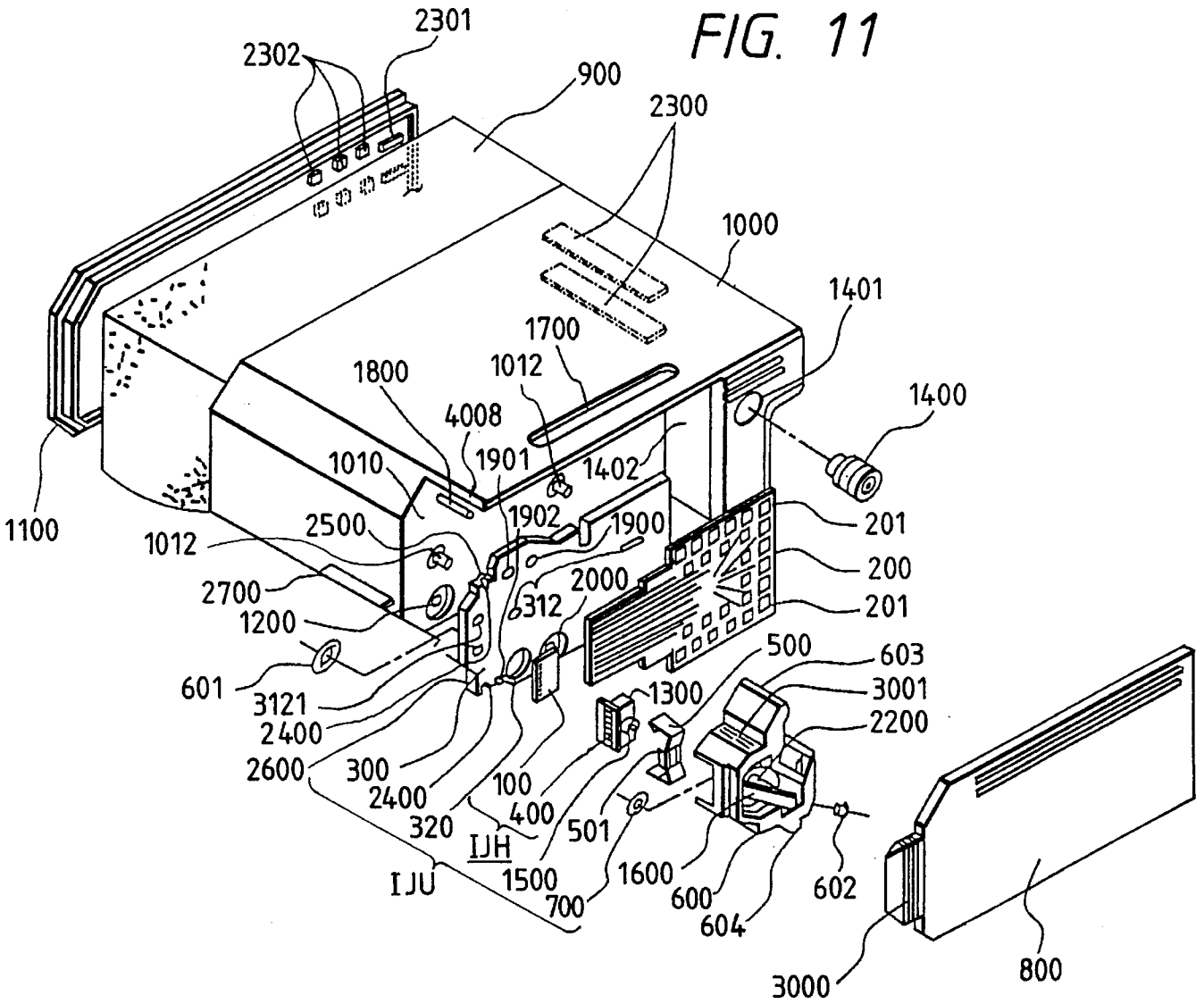
FIG. 11 is a schematic exploded perspective view of an ink jet cartridge according to the present invention.

One example of a recording head constituted using a grooved ceiling plate integral with an orifice plate which is processed for the water-repellent property is shown in FIG. 11. FIG. 11 shows an ink jet cartridge IJC integrally having a recording head portion and an ink tank portion for reserving the ink supplied to the head portion.

The ink jet cartridge IJC in this example has a large storage proportion of ink, as will be seen from FIG. 11, and is of the shape in which a leading end portion of ink jet unit IJU projects slightly from a front face of ink tank IT. This ink jet cartridge IJC is fixed and supported by positioning means for a carriage HC laid on the ink jet recording apparatus IJRA and electrical contacts, and is of a disposable type detachable from the carriage HC.

Constitution of ink jet unit IJU

The ink jet unit IJU is a unit with the bubble jet method for recording by the use of electricity-heat converters for generating the heat energy which causes the film boiling in the ink in accordance with an electric signal.

In FIG. 11, 100 is a heater board comprising electricity-heat converters (discharge heaters) arranged in a plurality of arrays on an Si substrate and electrical wirings of Al for supplying the electric power to them and formed using the film creation technique. 200 is a wiring substrate for the heater board 100, having wirings (e.g., connectable with the wire bonding) corresponding to the wirings of the heater board 100 and a pad 201 located at an end portion of the wirings for receiving the electrical signal.

1300 is a grooved ceiling plate provided with partition walls for separating a plurality of ink channels from each other, and a common liquid chamber for reserving the ink to supply the ink to each ink channel, in which an ink receiving port 1500 for receiving the ink supplied from an ink tank IT and introducing it to the common liquid chamber and an orifice plate 400 having a plurality of discharge ports corresponding to respective ink channels are integrally formed. The integral forming material is preferably polysulfone, but other forming resin materials can be also used. Note that the orifice plate has undergone the water-repellent treatment as previously described.

300 is a support body, for example, of metal, for supporting a back face of the wiring substrate 200 in the plane, which can serve as a bottom plate of the ink jet unit. 500 is a presser spring of the M-character shape, for pressing concentratedly a part of liquid channels, preferably, on an area in the neighborhood of discharge ports, in the line pressure, with a front flap 501, as well as pressing lightly the common liquid chamber with a central portion of the M-character. By causing the heater board 100 and the ceiling board 1300 to be engaged in a sandwiched state therebetween by a foot portion of the presser spring passing through a hole 3121 of the support body 300 to engage a back side of the support body 300, the concentrated urging force of the presser spring 500 and its front flap 501 can fix the heater board 100 and the ceiling plate 1300 by the pressure. Also, the support body 300 has positioning holes 312, 1900, 2000 engaging two positioning projections 1012 of the ink tank IT and positioning and thermal fusion holding projections 1800, 1801, and positioning projections 2500, 2600 for the carriage HC of the apparatus main body IJRA on the back side. In addition, the support body 300 has also a hole 320 for passing an ink supply tube 2200 (thereinafter described) therethrough which allows the supply of ink from the ink tank. The mounting of the wiring substrate 200 on the support body 300 can be performed by an adhesive. Note that recesses 2400, 2400 of the support body 300 are provided near the positioning projections 2500, 2600 (on the back side), respectively. And they lie on a plurality of extension lines of parallel grooves 3000, 3001 formed in peripheral three sides for a leading end area of the head portion in the assembled ink jet cartridge IJC (FIG. 3). Therefore, unnecessary matters such as contaminants or inks migrating along the parallel grooves 3000, 3001 will not lead to projections 2500, 2600. A lid member 800 having the parallel grooves 3000 formed therein forms a space portion for storing the ink jet unit IJU along with the ink tank, as well as an external wall of the ink jet cartridge IJC as shown in FIG. 5. Also, the ink supply member 600 having the parallel grooves 3001 formed therein forms an ink conduit 1600 communicating to the ink supply tube 2200 as previously described, in a cantilevered form with the supply tube side 2200 secured thereto, having a sealing pin for making reliable the capillary phenomenon between a secured side of the ink conduit and the ink supply tube 2200 inserted therein. Note that 601 is a packing for making a connecting seal between the ink tank IT and the supply tube 2200, and 700 is a filter provided at an end portion of the supply tube on the tank side thereof.

The ink supply member 600 is not only cheap and accurate in position, thereby eliminating the reduced accuracy on the formation and fabrication, because of its molding, but also has a stable abutment state against the ink receiving port 1500 of the conduit 1600, as the ink supply conduit 1600 is constructed in a cantilevered structure, so that it is made a structure suitable for mass production. In this example, under this abutment state, a more complete communicating state can be obtained reliably, simply by flowing a sealing adhesive from the side of the ink supply member thereinto. Note that the fixation of the ink supply member 600 to the support body 300 can be performed simply by passing pins (not shown) on the back side of the ink supply member 600 through holes 1901, 1902 of the support body 300 and fusing by heat the protruding portions onto the back side of the support body 300. Note that small projecting areas on the back portion heat fused are stored in depressions (not shown) within the wall face on the mounting side for the ink jet unit IJU, so that a positioning face of unit IJU can be obtained correctly.

Constitution of ink tank IT

The ink tank is constituted of a cartridge main body 1000, an ink absorbing member 900, and a lid member 1100 for sealing the ink absorbing member 900 after inserting it from the side opposite to the unit IJU mounting face of the cartridge main body 1000.

Figure 12:
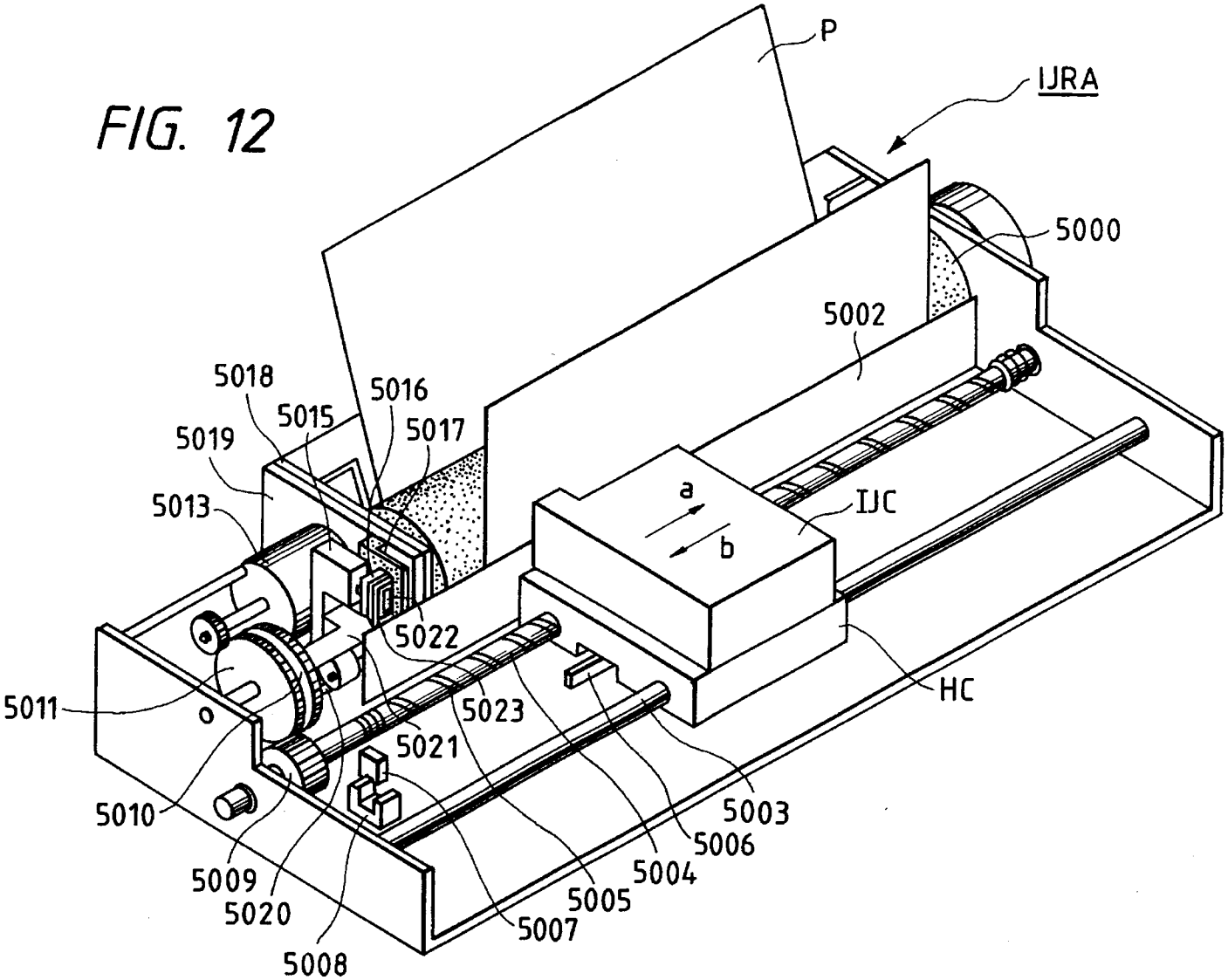
FIG. 12 is a perspective view schematically showing an ink jet apparatus according to the present invention.
Figure 13:
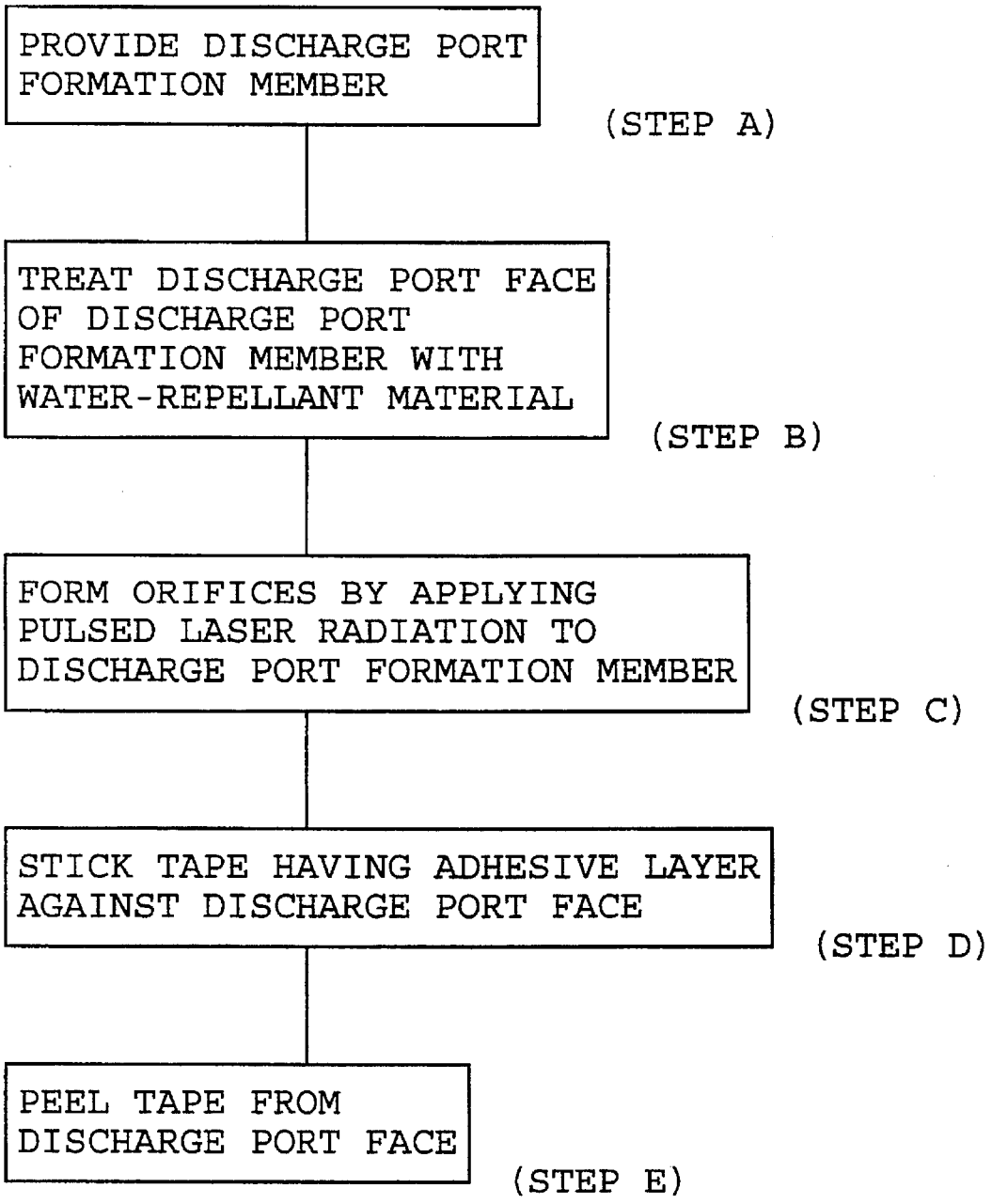
FIG. 13 is a flowchart depicting operation according to the present invention.

900 is an absorbing member for impregnating the ink, disposed within the cartridge main body 1000. 1200 is a supply port for supplying the ink to the unit IJU consisting of each portion 100 to 600 as above described, as well as an injection port for impregnating the ink into the absorbing member 900 by injecting the ink through the supply port 1200 in a process before disposing the unit on a portion 1010 of the cartridge main body 1000. Schematic explanation of apparatus main body FIG. 12 is a general view of an ink jet recording apparatus IJRA on which the previously-mentioned cartridge is mounted, the carriage HC being reciprocated in the directions of arrow a and b because of having pins (not shown) to engage into a line groove 5004 of a lead screw 5005 rotating via driving force transmission gears 5011, 5009 linked with the positive or negative rotation of a driving motor 5013. 5002 is a paper presser plate for pressing a paper against a platen 5000 across the moving direction of carriage. 5007, 5008 are photocouplers which are home position detecting means for switching the rotational direction of the motor 5013 by confirming the presence of a lever 5006 of carriage in this area. 5016 is a member for supporting a cap member 5022 for capping a front face of recording head, and 5015 is suction means for sucking an inside of the cap which makes the suction recovery of the recording head via an opening 5023 within the cap. 5017 is a cleaning blade, 5019 is a member for allowing the blade to move in forward and backward directions, both of which are supported on a main body support plate 5018. The blade is not limited to this form, but a well known cleaning blade can be also applied to this example. Also, 5021 is a lever for starting the suction in the suction recovery which moves along with the movement of a cam 5020 engaging the carriage, the driving force from the driving motor being controlled for the movement with well known transmission means such as a clutch switch.

These capping, cleaning and suction recovery are constituted to perform the desired operations at corresponding positions by the action of lead screw 5005 when the carriage comes to an area on the home position side, but desired operations are allowed to be carried out at known timings, which can be applied to this example. Each constitution as above described is a preferable invention as viewed either singly or in combination, and shows a preferable constitutional example for the present invention.

The present invention brings about excellent effects particularly in a recording head, recording device of the type having means for generating the heat energy for use in discharging the ink (e.g., electricity-heat converters or a laser beam) and causing the change of ink state with that heat energy, among the ink jet recording systems. That is, with the heat treatment of the above water repellent at a temperature of above 100° C., even if the orifice plate may experience the temperature elevation with the heat energy, the water repellent lies in a thermally stable condition, and is preferable to this method. Also, as described in the above examples, the coating of the water repellent in a solution state is a preferable invention, as the characteristics of water repellent can be utilized at maximum without damaging the shape of orifice plate. In this case, as the orifice plate is one having a sufficient durability against the heat energy for discharge, there is an advantage in a long term use.

In addition to these or singly, as the water repellent is prevented from entering into discharge ports by boring from a back side of the orifice plate formed with a water-repellent solid film as above described, this is a preferable embodiment for the present invention.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) though an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, as the recording head of the full line type having a length corresponding to the maximum width of recording medium which can be recorded by the recording device, either the constituion which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means electricity-heat converters or another heating elements or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural numbers.

Though the ink is considered as the liquid in the examples of the present invention as described above, the present invention is applicable to the ink solidifying at or below room temperature, and liquefying or liquid at the room temperature, or the ink liquefying when a recording enable signal is issued, as it is common to control the viscosity of ink to be maintained within a certain range for stable discharge by adjusting the temperature of ink in a range from 30° C. to 70° C. in the above ink jet. In addition, in order to avoid the temperature elevation due to the heat energy by positive utilization of the energy for the change of state from solid to liquid, or to prevent the evaporation of ink by using the ink stiffening in the shelf state, the ink which has a property of liquefying only with the application of heat energy, such as the ink to be discharged as the liquid because the ink liquefies with the application of heat energy in accordance with a recording signal or already solidifies when reaching a recording medium, is also applicable to the present invention.

In this case, the ink may be in the form of being held in recesses or through holes of porous sheet as liquid or solid matter, and opposed to electricity-heat converters, as described in Japanese Laid-Open Patent Applications No. 54-56847 or Japanese Laid-Open Patent Application No. 60-71260. The most effective method for inks as above described in the present invention is one based on the film boiling as above indicated.

As above described, the ink jet recording head takes the method of forming an image by discharging the ink through discharge ports so that peripheries around discharge ports are placed in the wetting state. This state may cause the deflected or improper ink discharge if this state is severe. To resolve this problem is a very important theme, but the present invention is intended for its improvement by the use of the technqiue of treating with the water repellent.

That is, there are three techniques; firstly, the water repellent itself of selected to be superior in the water-repellent property, and relatively excellent in the rubbing durability such as a cleaning blade. Secondly, to further improve the coupling between the water repellent for use and an orifice plate, an intermediate layer is formed to be superior in the coupling with respect to the orifice plate as well as the water repellent. Thirdly, after forming discharge ports with a laser beam, the after-treatment process eliminates the effect of hydrophilic byproducts yielded during the laser beam machining. Of course, even if these techniques are used individually, the water-repellent property of the discharge port formation face is excellent, but a combination of them allows a further reliable and stabler water-repellent treatment to be made, so that a quite stable water-repellent property can be exhibited in a long term, and a recording head with reduced degradation in the recording characteristics can be obtained.

We claim:

1. A method of manufacturing a recording head for use in an ink jet printer, comprising the steps of:

providing a discharge port formation member having a surface in which a plurality of orifices is to be formed;

treating a discharge port face of the discharge port formation member with a water-repellent material;

forming a plurality of orifices by applying radiation from a pulsed laser beam to the discharge port formation member which has been treated by the material having a water-repellent property, wherein forming the plurality of orifices creates byproducts; and sticking at least once a tape having an adhesive layer against the discharge port face of the discharge port formation member against at least peripheral portions of said orifices having the byproducts created in said orifice forming step sticking thereto and deposited therein, and peeling said tape therefrom.

* * * * *

UNITED STATES PATENT AND TRADEMARK OFFICE

CERTIFICATE OF CORRECTION

PATENT NO. : 5,594,479

DATED : January 14, 1997

INVENTOR(S) : Makoto Inoue, et al.

It is certified that error appears in the above-identified patent and that said Letters Patent is hereby corrected as shown below:

ON THE TITLE PAGE:

AT [30] FOREIGN APPLICATION PRIORITY DATA

"3-43658" should read --3-043658--.

AT [56] REFERENCES CITED, FOREIGN PATENT DOCUMENTS (PG. 2)

"64-122557 5/1988 Japan" should read
--63-122557 5/1988 Japan--.
"1131215 5/1989 Japan
248953 2/1990 Japan
21534774 6/1990 Japan" should read 1-131215 5/1989 Japan
2-48953 2/1990 Japan
2-153744 6/1990 Japan--.

COLUMN 2

Line 36, "to" should be deleted and "causes by" should read --as--.
Line 37 "being" should read --is--.

COLUMN 4

Line 15, "contain" should read --contains--.

UNITED STATES PATENT AND TRADEMARK OFFICE

CERTIFICATE OF CORRECTION

PATENT NO. : 5,594,479

DATED : January 14, 1997

INVENTOR(S) : Makoto Inoue, et al.

It is certified that error appears in the above-identified patent and that said Letters Patent is hereby corrected as shown below:

COLUMN 6

Line 53, "ether.)" should read --ether)--.

Line 60, $CF_2=CF'3CF_2CF(CF_3)-O-CF_2CF_2SO_2F$" should read --$CF_2=CF-CF_2CF(CF_3)-O-CF_2CF_2SO_2F$--.

COLUMN 7

Line 15, "liquid" should read --a liquid--.

COLUMN 11

Line 31, "③" should read --①--.

COLUMN 13

Line 36, "region" should read --a region--.

COLUMN 16

Line 14, "An" should read --A--.

Line 60, "150>C." should read --150°C.--.

COLUMN 18

Line 63, "11801," should read --1801,--.

COLUMN 19

Line 59, "Schematic" should read --¶ Schematic--.

UNITED STATES PATENT AND TRADEMARK OFFICE

CERTIFICATE OF CORRECTION

PATENT NO. : 5,594,479

DATED : January 14, 1997

INVENTOR(S) : Makoto Inoue, et al.

It is certified that error appears in the above-identified patent and that said Letters Patent is hereby corrected as shown below:

COLUMN 22

Line 30, "of" should read --is--.

Signed and Sealed this

Twentieth Day of January, 1998

*Attest:*

*Attesting Officer*

BRUCE LEHMAN

*Commissioner of Patents and Trademarks*